United States Patent [19]

Dapperheld

[11] Patent Number: 5,026,460

[45] Date of Patent: Jun. 25, 1991

[54] PROCESS FOR THE PREPARATION OF UNSATURATED HALOGENATED HYDROCABONS

[75] Inventor: Steffen Dapperheld, Kriftel, Fed. Rep. of Germany

[73] Assignee: Hoechst Aktiengesellschaft, Frankfurt am Main, Fed. Rep. of Germany

[21] Appl. No.: 324,572

[22] Filed: Mar. 16, 1989

[30] Foreign Application Priority Data

Mar. 19, 1988 [DE] Fed. Rep. of Germany ..... 3809296
Feb. 15, 1989 [DE] Fed. Rep. of Germany ..... 3904475

[51] Int. Cl.[5] ..... C25B 3/00

[52] U.S. Cl. ..... 204/59 R; 204/72; 204/78

[58] Field of Search ..... 204/73 R, 81, 72, 78, 204/59 R

[56] References Cited

U.S. PATENT DOCUMENTS 4,162,948 7/1979 Yagii et al. ..... 204/81
4,707,226 11/1987 Dapperheld ..... 204/81
4,800,012 1/1989 Dapperheld ..... 204/73 R

FOREIGN PATENT DOCUMENTS 0241685 10/1987 European Pat. Off. .
2135669 9/1984 United Kingdom .

*Primary Examiner*—John F. Niebling
*Assistant Examiner*—Steven P. Marquis

[57] ABSTRACT

Process for the preparation of unsaturated halogenated hydrocarbons of the formula $R^1—CR^2{=}CR^2—R^2$ in which $R^1$ and $R^2$ independently of one another are hydrogen, chlorine or fluorine, $R^2$ is also $—C(R^1)_2—R^3$ or the grouping $[C(R^1)_2]_m—C(R^1)_2$ represents two of the radicals $R^2$, by electrolysis in the presence of certain onium compounds and metal salts, the electrolysis cells being divided or undivided. The process can be carried out continuously or discontinuously under atmospheric pressure or under an elevated pressure up to 10 bar and at temperatures from −40° C. up to the boiling point of the electrolyte; the current density is in the range from 1 to 600 mA/cm$^2$. The cathode is generally composed of carbon material. The products obtained are suitable for use as starting materials for the preparation of polymers containing fluorine.

17 Claims, No Drawings

PROCESS FOR THE PREPARATION OF UNSATURATED HALOGENATED HYDROCABONS

The invention relates to a process for the preparation of unsaturated halogenated hydrocarbons by electrolysis in the presence of certain onium compounds and metal salts.

Unsaturated halogenated hydrocarbons such as tetrafluoroethylene, chlorotrifluoroethylene, vinylidene fluoride or hexafluoropropene are of great industrial importance, above all for the preparation of fluorinated plastics and inert fluids.

Halogenated olefins, in particular fluorine-containing olefins, are prepared, inter alia, by decarboxylation of fluorocarboxylic acids, pyrolysis of chlorofluorohydrocarbons or thermal or base-catalyzed dehydrohalogenation of halogenoalkanes containing hydrogen.

Particularly pure products are given by the dehalogenation of bromine-containing or chlorine-containing fluorohydrocarbons, which is carried out, for example, by means of zinc in methanol.

Since this process is associated with the production of large amounts of zinc salts, processes have been developed to produce the zinc electrochemically and to regenerate it after the reaction. A process of this type is carried out in accordance with the reaction equation $$CF_2Cl—CFCl_2 \rightarrow CF_2{=}CFCl + Cl_2$$

(German Patent 2,818,066). A sheet of zinc or aluminum is used as the cathode, but other metal cathodes are also suitable. The catalyte is composed of $CF_2Cl—CFCl_2$, water, zinc chloride and an anionic detergent.

Electrolysis is carried out at 10 to 15 volts and a current density of 55 mA/cm$^2$ in a cell divided by a perfluorinated cation exchanger membrane. Chlorine is evolved at the anode, which is composed of platinum. The yield of $CF_2{=}CFCl$ at a current efficiency of 81.9% is approx. 90%.

The process is not economic, however, since the current density is too low for an industrial process, the voltage and hence the energy consumption are too high and the platinum anodes are too expensive.

The dehalogenation of organic halogen compounds such as $CF_2Cl—CFCl_2$ by means of electrochemically deposited metals having dehalogenating properties, such as Zn, Sb, As, Cd and Fe (published U.S. application Ser. No. 762,873) is also known. In this case the electrolysis is carried out at copper electrodes in an aqueous ethanolic solution of the metal salt. The electrolysis cell itself is not divided, but the anode gas and the cathode gas are collected separately from one another. A disadvantage in this process is, above all, the use of copper as the anode material, since copper is, as is known, not a stable material for anodes at which chloride ions are oxidized to chlorine, as is inevitably the case in an undivided electrolysis cell. In addition, the electrolysis cell suggested is not suitable for an industrial process and the current density is too low to ensure that the process is carried out economically.

A further process operates at even lower current densities (USSR Patent 520,342). $CF_2Cl—CFCl_2$ is electrolyzed is an aqueous emulsion in the presence of an emulsifier at graphite electrodes and at a current density of 30 mA/cm$^2$. An 80% yield of a pure product is obtained.

A disadvantage in this process is the use of the conducting salt $LiClO_4$, which is expensive and an explosion hazard. Additionally, damage to the cation exchanger membrane occurs when the electrolysis is carried out in an industrial flow-type cell, as described in Comparison Example 1.

The problem of damage to the membrane can admittedly be overcome by the use of porous, ceramic diaphragms. However, in this case mixing of the anolyte and the catholyte and also of the anolyte exit gas and the catholyte exit gas must be expected, so that on the one hand the olefin reacts with the chlorine produced at the anode and on the other hand explosive chlorine detonating gas can form from chlorine and the by-product hydrogen formed at the cathode.

Ceramic diaphragms are employed in various processes (USSR Patent 231,131, Zh. Prikl. Chim. 1978, volume 51, pages 701 and 703). The electrolysis of chlorofluorohydrocarbons such as $CF_2Cl—CFCl_2$ or $CF_2Cl—CF_2Cl$ to give chlorotrifluoroethylene and tetrafluoroethylene can be carried out in basic or neutral mixtures of water and polar organic solvents such as isopropanol, acetone or dioxane. At current densities of 17 to 34 mA/cm$^2$ and voltages of 4 to 9 volts the current efficiencies are between 53.3 and 21.7%.

In addition to the base KOH, which is added in order to neutralize the hydrochloric acid formed and thus causes an undesirable production of salt, it is also necessary to add approx. 0.15 g of lead nitrate per hour to the catalyte, which is composed of 75 ml of KOH solution in water and 75 ml of isopropanol, in order to maintain the activity of the lead cathode As well as the problems associated with the use of ceramic diaphragms, corrosion or passivation of the cathode also occur in the processes described. As a result of the addition of bases and lead nitrate solutions to the catholyte the resulting effluents contain not only salt, but also heavy metals.

The use of a ceramic diaphragm is also quoted in another literature reference (Italian Published Application 852,487). The preferred cathode in this process is mercury, a metal which is unsuitable for an industrial process for toxicological and chemical engineering reasons. Electrolysis is carried out at a controlled voltage in a catholyte composed of water and water-soluble solvents, such as dioxane or acetone, and a buffer salt, such as potassium acetate.

Ecomonic operation of the process is very adversely affected by the high production of salt in the effluent, the use of mercury and the expensive control of the voltage of the cathode.

Another known process is the electrolysis of halogenated hydrocarbons to give halogenated olefins at porous, hydrophobic plastic/metal composite electrodes composed of, for example, copper or zinc; this is carried out in a neutral or slightly basic aqueous medium or in an electrolyte composed of 2-molar lithium perchlorate in water (USSR Patent 702,702, Elektrochimya, 1986, volume 22, page 1132, CA:105:180,351; Zh. Prikl. Chim. 1986, volume 59, page 1179, CA:105:31,815). In addition to the inevitable production of salt and, where appropriate, the use of lithium perchlorate the instability of the Zn electrodes is also a disadvantage, because they become hydrophilic and spongy during the electrolysis.

It was therefore the object to provide an efficient process for the dehalogenation of chlorofluorohydrocarbons with the formation of chlorofluoroolefins or fluoroolefins which is not associated with the disadvantages of the processes mentioned above, such as passivation or corrosion of the cathodes, the use of mercury, which is toxic, the instability of ion exchanger membranes, the hazard of the evolution of chlorine detonating gas, low current density, low current efficiency and high production of salt in the effluent.

This object is achieved by means of the process according to the invention.

The invention relates to an electrochemical process for the preparation of compounds of the formula

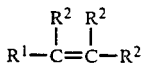

(I)

which comprises electrolyzing A) a compound of the formula

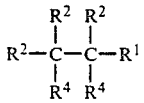

(II)

in which the $R^1$s independently of one another are hydrogen, chlorine or fluorine, the $R^2$s are $R^1$ or $—C(R^1)_2—R^3$, or the grouping $[C(R^1)_2]_m—C(R^1)_2$ represents two of the radicals $R_2$, $R^3$ is $—(CH_2)_n—CH_2—R^5$, $—(CF_2)_n—CH_2—R^5$, $—(CF_2)_n—CF_2—R^5$ or $C_1$-$C_{12}$-alkyl which is partly or completely fluorinated, the $R^4$s independently of one another are chlorine, bromine or iodine, $R^5$ is $R^1$, bromine, iodine, $—CO—R^5$ or $—SO_2—R^6$, $R^6$ is —OH, —O—alkyl having 1 to 6 carbon atoms in the alkyl radical, fluorine or chlorine, m and n independently denote zero or an integer from 1 to 12, preferably 1 to 6, and at least one $R^1$ is fluorine, in a divided or undivided electrolysis cell in the presence of B) at least one onium compound containing at least one nitrogen or phosphorus atom, and C) at least one soluble metal salt having a hydrogen overvoltage greater than 0.25 volts, relative to a current density of 100 mA/cm$^2$, in D) an electrolyte and E) in the absence or presence of 5 to 60% by weight, relative to the total amount of the electrolyte, of at least one inorganic and/or organic acid and/or salts thereof, under atmospheric pressure or under an elevated pressure of up to bar at a current density of 1 to 600 mA/cm$^2$ and at a temperature within the range from −40° C. to the boiling point of the electrolyte, at a carbon electrode. In this process it is preferable to employ, in component C), salts of the metals lead (Pb), chromium (Cr), copper (Cu), silver (Ag), thallium (Tl) and bismuth (Bi).

The onium compounds B) containing at least one nitrogen or phosphorus atom are compounds of the formulae III to VI below.

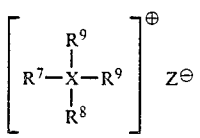

(III)

-continued

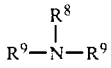

(IV)

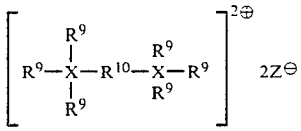

(V)

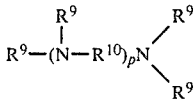

(VI)

in which

X denotes phosphorus or nitrogen, $R^7$ denotes hydrogen, alkyl, cycloalkyl, aralkyl having 1 to 18 carbon atoms in the alkyl radical and aryl having 6 to 12 carbon atoms, $R^8$ is the same as $R^7$ or denotes $—(R^7—O)_pR^7$, $R^9$ is the same as $R^7$ or $R^8$ or denotes $—CH_2(Y)_qCH_2—$, $R^{10}$ is $—(CH_2)_p—$, $—CH_2—[O—(CH_2)_p]_q—O—(CH_2)_2—$, p is an integer from 1 to 12, q is zero or an integer from 1 to 6, Y denotes nitrogen, oxygen, sulfur or $—CH_2—$ and Z denotes —OH or an anion of an inorganic or organic acid. Examples of these acids are the various hydrogen halide acids, sulfuric acid, nitric acid, nitrous acid, phosphoric acid, $H_3BO_3$, $HBF_4$, $HPF_6$, formic acid, acetic acid and oxalic acid.

Starting compounds of the formula (II) are polyhalogenated alkyl compounds, preferably the dichlorides, dibromides or bromochloride addition products of appropriate olefins, derived, for example, from the following olefins: 1,1,2,2-tetrafluoroethylene, 1,1,2-trifluoro-2-chloroethylene, 1,1,2-trifluoroethylene, the various dichlorodifluoroethylenes, difluoroethylenes or difluorochloroethylenes, 1,1,2-trichloro-2-fluoroethylene, fluoroethylene, the various dichlorofluoroethylenes and chlorofluoroethylenes and hexafluoropropene.

The compounds of the formula (II) are employed in concentrations from 1% to 60% by weight, preferably 5 to 50% by weight, relative to the total amount of the electrolyte D) in the undivided cell or of the catholyte $D_1$) in the divided cell.

The process according to the invention is carried out in divided or undivided cells. Accordingly, a catholyte $D_1$) or anolyte $D_2$) are present in divided cells, whereas only an electrolyte D) is present in undivided cells. In interpreting the description and the claims, account must be taken of these facts. Ion exchanger membranes, in particular cation exchanger membranes composed of a polymer such as polystyrene, preferably composed of perfluorinated polymers having carboxylic and/or sulfonic acid groups, are used for dividing the cells into the anode compartment and the cathode compartment. It is also possible to use stable anion exchanger membranes.

The electrolysis can be carried out in any conventional electrolysis cell, for example in beaker cells or plate and frame cells or cells having fixed bed electrodes or fluidized bed electrodes. It is possible to use either a monopolar circuit or a bipolar circuit for the electrodes.

It is possible to carry out the electrolysis either continuously or discontinuously.

The electrolysis is generally carried out at carbon cathodes. It is therefore possible to use as carbon cathodes any known carbon electrode materials, for example electrode graphites, impregnated graphite materials, porous graphites, carbon felts, vitreous carbon and also carbon/plastic composite materials. Examples of plastics employed in the composite materials are polytetrafluoroethylene and polyvinylidene fluoride. Any known materials at which the corresponding anode reactions take place can be used as the anode material. For example, lead, lead dioxide on lead or other supports, platinum or titanium dioxide doped with noble metal oxides (such as ruthenium dioxide) on titanium are suitable for the evolution of oxygen from dilute sulfuric acid. Carbon or titanium dioxide doped with noble metal oxides on titanium are suitable, for example, for the evolution of chlorine from aqueous solutions of alkali metal chlorides or aqueous or alcoholic solutions of hydrogen chloride.

The use of an anolyte $D_2$) is necessary for operating in divided electrolysis cells. Suitable anolyte liquids are aqueous mineral acids or solutions of their salts, for example dilute sulfuric acid, hydrochloric acid, solutions of sodium sulfate or sodium chloride or solutions of hydrogen chloride in alcohol.

An example of the reaction taking place at the anode is the evolution of halogen from aqueous or alcoholic solutions of alkali metal halides or hydrogen halides.

The electrolyte D) in the undivided cell or the catholyte $D_1$) in the divided cell contains the compound of the formula (II) employed and is composed of water, one or more organic solvents or a mixture of both. Examples of suitable organic solvents are short-chain aliphatic alcohols, such as the various butanols; diols, such as propanediol, and also polyethylene glycols and ethers thereof; ethers, such as tetrahydrofuran, amides, such as hexamethylphosphoric triamide, or nitriles, such as propionitrile; ketones, such as acetone; and also sulfolane or dimethylsulfoxide, but preferably methanol, ethanol, the various propanols, ethylene glycol, dioxane, N,N-dimethylformamide and N-methyl-2-pyrrolidone.

Under the conditions described, reactions can occasionally take place between the organic solvent and the halogen formed, leading to the formation of undesirable byproducts, such as, for example, the formation of dichlorodimethyl ether from methanol, chlorine and hydrogen chloride. These side reactions can be prevented by carrying out the electrolysis in an electrolyte D) or catholyte $D_1$) which is a mixture of water and at least one organic acid and/or at least one salt of this acid and which, with the exception of the organic solvent, contains the other additives described.

Soluble salts of metals C) having a hydrogen overvoltage of at least 0.25 volts, relative to a current density of 100 mA/cm$^2$, are added to the electrolyte D) in the undivided cell or to the catholyte $D_1$) in the divided cell, in concentrations from $10^{-5}$ to 5% by weight, preferably $10^{-3}$ to 5% by weight, in each case relative to the total amount of electrolyte or catholyte.

The preferred anions of these salts are $Cl^-$, $SO_4^{2-}$, $NO_3^-$, $CH_3COO^-$ and $PO_4^{3-}$. The salts can be added direct or can also be produced in the solution, for example by adding soluble oxides or carbonates. Care should be taken in the choice of anions that no compounds insoluble in the electrolyte are formed with the cations of the abovementioned metals.

In addition to C), the metal salts, one or more compounds B) containing at least one nitrogen or phosphorus atom in accordance with the formulae (III) to (VI) are added to the electrolyte or catholyte in concentrations from $10^{-5}$ to 10% by weight, preferably $10^{-4}$ to 5% by weight, relative to the total amount of D) or $D_1$).

Suitable compounds of the formulae (III) to (VI) are, in particular, tetramethylammonium, tetraethylammonium, tetrapropylammonium, tetrabutylammonium, tetramethylphosphonium, tetraethylphosphonium, tetrapropylphosphonium, tetrabutylphosphonium, benzyl-, octyl-, decyl-, dodecyl-, tetradecyl-, hexadecyl-, or octadecyl-trimethylammonium or benzyl-, octyl-, decyl-, dodecyl-, tetradecyl-, hexadecyl- or octadecyl-trimethylphosphonium, dioctyl-, didecyl-, didodecyl-, ditetradecyl-, dihexadecyl- or dioctadecyl-dimethylammonium or dioctyl-, didecyl-, didodecyl-, ditetradecyl-, dihexadecyl- or dioctadecyl-dimethylphosphonium, or methyl trioctylammonium and mixtures thereof. It is also possible, however, to employ primary, secondary and tertiary amines from which the onium compounds are formed in the course of the electrolysis. The nature of the anions of the compounds B) is not important for the process; the halide, sulfate, tetrafluoroborate and hydride ions are preferred.

In order to increase the conductivity, it is possible to add to the catholyte in the divided cell or to the electrolyte in the undivided cell as component E) at least one inorganic and/or organic acid and salts thereof in concentrations from 5 to 60, preferably 10 to 50, % by weight, relative to the total amount of the electrolyte. Inorganic acids which can be used are hydrochloric, boric, phosphoric, sulfuric or tetrafluoroboric acid, preference being given, however, to the organic acids. Suitable organic acids are water-soluble monocarboxylic or dicarboxylic acids, for example $C_1$–$C_5$-alkanecarboxylic acids, such as formic, acetic, propionic, butyric or valeric acid, and halogenated acids, such as chloroacetic acid or trifluoroacetic acid; malonic or succinic acid, ethercarboxylic acids, such as methoxyacetic or ethoxyacetic acid, and fluorinated ether-carboxylic acids of the formula $$CF_3CF_2-CF_2-O-(CF(CF_3)-CF_2-O)_r-CF(CF_3)-COOH$$

in which r = 0–2;

$C_1$–$C_5$-alkanesulfonic acids, such as methanesulfonic and ethanesulfonic acid, and halogenated acids, for example trifluoromethanesulfonic acid; aromatic sulfonic acids such as benzenesulfonic acid or toluenesulfonic acid, and $C_1$–$C_5$-alkanephosphonic acids, such as methanephosphonic or ethanephosphonic acid.

The ammonium, sodium, potassium and/or $C_1$–$C_4$-tetraalkylammonium salts are used as salts of the acids mentioned.

Formic, acetic, chloroacetic, trifluoroacetic and propionic acid and methoxyacetic acid and the fluorinated ether-carboxylic acids $$CF_3-CF_2-CF_2-O-(CF(CF_3)-CF-CF_2-O)_r-CF(CF_3)-COOH$$

-continued in which r = 0 and 1 and methanesulfonic, ethanesulfonic, methanephosphonic and ethanephosphonic acid and salts thereof are preferred.

In the case of electrolysis in an undivided cell it is possible to add to the electrolyte compounds which are oxidized at a more negative potential than the halide ions liberated, in order to prevent the formation of the free halogen. Examples of suitable compounds are those of the formulae (III) and (IV) in which the anion Z is a radical of oxalic acid, methoxyacetic acid, glyoxylic acid, formic acid and/or hydrazoic acid, for example the tetramethylammonium and tetraethylammonium compounds of the acids mentioned.

The electrolysis is generally carried out under atmospheric pressure. Since some of the suitable organic acids or salts thereof are not sufficiently soluble under the conditions described, in particular at low temperatures, and some of the starting materials have very low boiling points, it can be necessary to carry out the electrolysis under an elevated pressure of up to 10 bar, preferably up to 7 bar and especially up to 5 bar and, if appropriate, at an elevated temperature. The current density in the electrolysis is generally 1 to 600 mA/cm$^2$, preferably 10 to 500 mA/cm$^2$ and especially 20 to 400 mA/cm$^2$.

The electrolysis temperature is within the range from −40° C. up to the boiling point of the electrolyte or catholyte employed, preferably −30° C. to 90° C. and especially −10° to 80° C.

Electrolysis under an elevated pressure makes it possible to shift the boiling point of the electrolyte or catholyte to higher values in order thereby to improve the solubility of the starting compounds and of the acids or salts.

The pH of the electrolyte can be varied over the known pH range between 0 and 14.

Electrolysis at a pH of less than 7 is advantageous, however, since under these conditions the metal ions employed do not form sparingly soluble compounds which are able to destroy the cation exchanger membrane of a divided cell. In particular, the electrolysis is carried out at a pH between 5 and 0.2.

In general, the reaction products leave the electrolysis set-up in the gaseous state or, under an elevated pressure, in a condensed form and are collected in suitable vessels, for example cold traps.

The working up of the electrolyte or catholyte, the isolation of non-gaseous products and the recovery of unreacted halogenofluorohydrocarbons is effected by extraction and/or distillation in a known manner. The added metal salts and the compounds of the formulae (III) to (VI) and the acids or salts present in the electrolyte or catholyte can, inter alia, be recycled to the electrolysis, since the starting materials and the hydrogen halide acids formed in most cases have boiling points lower than those of the organic acids and thus can be removed easily. The hydrogen halide acids can be fed to the anolyte, where they are oxidized to halogen.

The products obtained by the process according to the invention are suitable for use as starting materials for the preparation of polymers containing fluorine.

Two types of electrolysis cells were used for the examples below, but divided cells were employed in all cases.

Electrolysis cell 1

A so-called circulation cell with an electrode surface area of 0.02 m$^2$. Electrode graphite or impregnated graphite (®Diabon N made by Sigri, Meitingen, Germany) was used as the cathode and impregnated graphite or a platinum sheet was used as the anode. Anolyte: 15 to 35% strength aqueous hydrochloric acid, saturated methanolic hydrochloric acid or 0.5 to 2 N aqueous sulfuric acid. The interelectrode distance was 4 mm and polyethylene grids were used as a spacing piece. The cation exchanger membrane was a two-layer or single-layer membrane composed of a copolymer formed from a perfluorosulfonyl ethoxyvinyl ether and tetrafluoroethylene (type ®Nafion 324 or 423 made by DuPont, Wilmington, Del., USA), Electrolysis cell 2

A jacketed glass pot cell having a volume of 350 ml; cathode (®Diabon N made by Sigri, Meitingen, Germany); anode: platium grid or graphite or lead sheet (20 cm$^2$); cathode surface area: 12 cm$^2$; interelectrode distance: 1.5 cm; anolyte: as in electrolysis cell 1; cation exchanger membrane: Nafion 324; mass transfer: by magnetic stirrer.

EXAMPLES

1) Electrolysis cell: 1

Starting catholyte: 3 litre of methanol, 200 ml of dilute hydrochloric acid, 5 g of $[CH_3(C_8H_{17})_3N]\ominus Cl\oplus$, 2 g of $Pb(OCOCH_3)_2 . 2H_2O$ and 710 g of $CF_2Cl—CFCl_2$.

In the course of the electrolysis, which was operated continuously, 2.2 kg of $CF_2Cl—CFCl_2$ and 4 g of lead acetate were added in portions to the catholyte. The $CF_2{=}CFCl$ formed left the electrolysis chamber in the gaseous state and was condensed in cold traps at −78° C. Temperature: 38° to 25° C., voltage: 9.5 to 7 volts, current density: 250 mA/cm$^2$, flow rate: 1400 litres/hour.

After a charge of 331 ampere-hours had been consumed, electrolysis was discontinued and the catholyte was worked up by distillation. 1150 g of $CF_2Cl—CFCl_2$ were recovered. The condensed gas was subjected to refrigerated distillation. Yield 636 g of $CF_2{=}CFCl$ (97.6%). The current efficiency was 88.4%.

2) Electrolysis cell:1

Starting catholyte: 2 litres of ethanol, 200 ml of concentrated hydrochloric acid, 2 g of $Pb(OCOCH_3)_2 . 2H_2O$, 2 g of $[(C_4H_9)_4P]\ominus Br\oplus$, 600 g of $CF_2Cl—CFCl_2$.

Temperature: 28° to 23° C., voltage: 12 to 9.5 volts, current density: 200 mA/cm$^2$, flow rate 1000 litres/hour.

After a charge of 132 ampere-hours had been consumed, 179 g of $CF_2{=}CFCl$ (99%) were obtained after purification by distillation. The current efficiency was 67%.

3) Electrolysis cell 2, starting catholyte: 150 ml of dimethylformamide, 10 ml of concentrated hydrochloric acid, 0.5 g of $Bi(NO_3)_3$, 0.5 g of $[CH_3(C_8H_{17})_3N]\ominus Cl\oplus$ and 70 g of $CF_2Br—CFClBr$.

Temperature: 40° to 28° C., voltage: 47 volts at the start, then falling to 16 volts, current density: 250 mA/cm$^2$.

After a charge of 9 ampere-hours has been consumed, 17.1 g of $CF_2{=}CFCl$ (99.3%) were obtained after purification by distillation. 29.6 g of $CF_2Br—CFBrCl$ were recovered. The current efficiency was 85.3%.

4) Electrolysis cell 2, modified in that the anode and cathode compartment are separated from one another by an anion exchanger membrane of type ®Neosepta AV-4T made by Tokuyama-Soda, Tokuyama City, Japan.

Starting catholyte: 200 ml of methanol, 20 ml of concentrated hydrochloric acid, 1 g of $Cr_2(SO_4)_3$, 2 g of $[(C_{16}H_{33})_2N(CH_3)_2]\ominus Cl\oplus$ and 70 g of $CF_2Br—CFClBr$.

Temperature: 20° to 22° C., voltage: 10 to 11 volts, current density: 167 mA/cm$^2$.

After a charge of 8 ampere-hours had been consumed, 15 g of $CF_2{=}CFCl$ (99.3%) were obtained after distillation, at a conversion of 35.6 g of $CF_2Br—CFBrCl$.

5) Electrolysis cell 2, modified in that a cation exchanger membrane composed of non-fluorinated polymers of the type ®Selemion LMV/CHR made by Asahi Glass, Tokyo, Japan was used.

Starting catholyte: 150 ml of methanol, 10 ml of HBF (50% strength in water), 0.5 g of $AgNO_3$, 1 g of $[(C_{16}H_{33})N(CH_3)_3]\ominus Br\oplus$ and 70 g of $CF_2Br—CFClBr$.

Temperature: 20° to 25° C., voltage: 10 to 12 volts, current density: 167 mA/cm$^2$.

After a charge of 8 ampere-hours had been consumed and 35.5 g of $CF_2Br—CFClBr$ had been converted, 14.1 g of $CF_2{=}CFCl$ (92.8%) were obtained after distillation.

6) Electrolysis cell 2:

Starting catholyte: 150 ml of dioxane, 50 ml of N,N-dimethylformamide, 15 ml of $HBF_4$ (50% strength in water), 1 g of $[(C_4H_9)_4N]\ominus HSO4\oplus$, 0.5 g of TlCl and 70 g of $CF_2Br—CFBrCl$.

Temperature: 35° to 30° C., voltage: 40 to 20 volts, current density: 250 mA/cm$^2$.

After a charge of 11.5 ampere-hours had been consumed and 35 g of $CF_2Br—CFClBr$ converted, 14 g of $CF_2{=}CFCl$ (94.2%) were obtained after purification by distillation.

7) Electrolysis cell 1, modified in that the anode was composed of vitreous carbon (®Sigradur K made by Sigri, Meitingen, Germany). A 25% strength solution of $HBF_4$ in water was used as the anolyte liquid.

Starting catholyte: 3 litres of methanol, 200 ml of dilute hydrochloric acid, 2 g of $Pb(OCOCH_3)_2.2H_2O$, 3 g of $[CH_3(C_8H_{17})_3N]\ominus Cl\oplus$ and 1000 g of $CF_2Br—CHFCl$.

A further 835 g of $CF_2Br—CHFCl$ were added to the catholyte during the electrolysis. The electrolysis product was collected continuously in cold traps at −78° C.

Temperature: 36° to 49° C., voltage: 9.5 to 8 volts, current density: 250 mA/cm$^2$, flow rate: 1500 litres/-hour.

After a charge of 476 ampere-hours had been consumed the electrolysis was discontinued and the catholyte was worked up by distillation. 194 g of $CF_2Br—CFHCl$ were recovered. 680 g of $CF_2{=}CFH$ (yield: 99%) were obtained. The current efficiency was 93.9%.

8) Electrolysis cell 1:

Starting catholyte: 2.5 litres of ethanol, 200 ml of concentrated hydrochloric acid, 500 g of $CF_2Cl—CCl_3$, 1 g of $Pb(OCOCH_3)_2.2H_2O$ and 2 g of $[(C_4H_9)_4N]\ominus Br\oplus$.

Temperature: 28° to 46° C., voltage: 13 to 7.5 volts, current density: 200 mA/cm$^2$, flow rate: 500 litres/-hour.

The product was removed continuously from the catholyte under a reduced pressure of 400 mbar during the electrolysis.

After a charge of 300 ampere-hours had been consumed 263 g of $CF_2{=}CCl_2$ (86.9%) were obtained and 35 g of $CF_2Cl—CCl_3$ were recovered from the catholyte.

9) Electrolysis cell 2:

Starting electrolyte: 180 ml of methanol, 5 g of $[(CH_3)_4P]\ominus BF_4\oplus$, 20 g of $CF_3—CFBr—CF_2Br$ and 0.7 g of $CuSO_4$.

Temperature: 30° to 48° C., voltage: 28 to 10 volts, current density: 166 mA/cm$^2$.

After a charge of 2.87 ampere-hours had been consumed 5.8 g of $CF_3{=}CF—CF_2$ (72.5%) were obtained.

10) Electrolysis cell 2:

28 7 g of $CCl_3—CFCl—CFCl_2$, 200 ml of methanol, 0.5 g of $Pb(OCOCH_3)_2.2H_2O$ and 4 g of $[(CH_3)_4N]\ominus Cl\oplus$.

Current density: 170 mA/cm$^2$, voltage: 60 volts at start, than falling to 9 volts, temperature: 30° C.

After a charge of 22.2 ampere-hours had been consumed, 500 ml of water were added to the catholyte, and the mixture was extracted with pentane. The following were obtained after the pentane had been distilled off:

5.97 g of $CCl_3CFCl—CCl_3$
15.41 g (89.9%) of $CCl_2{=}CF—CFCl_2$
0.09 g of $ClFC{=}CF—CCl_3$
0.07 g of $HFC{=}CF{=}CCl_3$ and
0.09 g of $CGCl_2—CFCl—CFCl_2$ 11) Electrolysis cell 2:

Starting catholyte: 20 g of $CF_2Br—CFBr—CH_2—CH_3$, 100 ml of methanol, 2 g of $[(CH_3)_4N]\ominus Cl\oplus$, 0.5 g of $[(C_4H_9)_4N]\ominus HSO_4\oplus$ and 0.2 g of $pb(OCOCH_3)_2.2H_2O$.

Charge consumed: 4.93 ampere-hours, temperature: 40° to 24° C., current density: 164 to 41 mA/cm$^2$, voltage: 13 to 4.5 volts.

Working up as in Example 10.

Results of electrolysis: 0.8 g of $CF_2Cl—CFBr—CH_2—CH_3$ and 8.3 g (79.6%) of $CF_2{=}CF—CH_2—CH_3$.

12) Electrolysis cell 2:

Starting catholyte: 10 g of $CF_2Br—CFCl—CH_2—CH_2$-Br, 100 ml of methanol, 2 g of $[(CH_3)_4N]\ominus Cl\oplus$, 0.5 g of $[C_4H_9]_4N]\ominus Br\oplus$ and 2 g of $pb(OCOCH_3)_2.2H_2O$.

Charge consumed: 2.1 ampere-hours, temperature: 12° to 10° C., current density: 41 mA/cm$^2$, voltage: 9 to 7.2 volts.

Working up as in Example 10.

Results of electrolysis: 0.1 g of $CF_2Br—CFCl—CH_2—CH_2Br$ and 2.73 g (67.7%) of $CF_2{=}CF—CH_2—CH_2—Br$ 13) Electrolysis cell 2:

Starting catholyte: 10 g of $CF_2Br—CFCl—(CH_2)_3—CH_2Br$, 100 ml of methanol, 2 g of $[(CH_3)_4N]\ominus Cl\oplus$, 0.5 g of $[C_4H_9]_4N]\ominus HSO_4\oplus$ and 0.2 g of $Pb(OCOCH_3)_2.2H_2O$.

Charge consumed: 1.66 ampere-hours, temperature: 17° to 15° C., current density: 82 to 41 mA/cm$^2$, voltage: 13 to 7 volts.

Working up as in Example 10.

Results of electrolysis: 0 49 g of $CF_2Br—CFCl—(CH_2)_3—CH_2Br$ and 4.9 g (75%) of $CF_2=CF—(CH_2)_3—CH_2Br$ 14) Electrolysis cell 2:

Starting electrolyte: 200 ml of isopropanol, 100 ml of N,N-dimethylformamide, 80 ml of water, 8 g of $[(CH_3)_4N]\ominus OSO_2—OCH_3\oplus$, 1.6 g of $Pb(OCOCH_3)_2.2H_2O$ and 20 g of $CF_2Cl—CFCl—CF_2Cl$.

Temperature: 46° to 35° C., current density: 166 to 83 mA/cm², voltage: 20 to 6 volts, charge consumed: 4.32 ampere-hours.

6.9 g of condensate were collected in a cold trap during the electrolysis. Product still dissolved in the catholyte was isolated under reduced pressure (40° C., 400 mbar). Altogether, 7.8 g of $CF_2Cl—CF=CF_2$ (87.1%) having a boiling point of 7.5° C. were obtained.

15) Electrolysis cell 1:

Starting catholyte: 1000 cc of 100% strength acetic acid, 500 g of sodium acetate, 3000 cc of water, 1000 g of $CF_2ClCFCl_2$, 2 g of $Pb(OCOCH_3)_2.2H_2O$ and 2 g of $[CH_3(C_8H_{15})_3N]\ominus Cl\oplus$.

Temperature: 35°-45° C., current density: 200 mA/cm², voltage: 10-9 volts, flow rate: 400 litres/hour, pH: 4.2.

The $CF_2=CFCl$ formed left the cathode compartment in gaseous form and was condensed in cold traps at −78° C. After a charge of 195 ampere-hours had been consumed and 6.6 litres of hydrogen evolved, the electrolysis was discontinued and 351 g of unreacted starting material were recovered from the catholyte by distillation. The condensed gas was subjected to refrigerated distillation, when 372 g of $CF_2=CFCl$ (95.1%) were obtained. The current efficiency was 87.8%.

16) Electrolysis cell 1:

Starting catholyte: 2000 cc of 100% strength acetic acid, 2000 cc of water, 500 cc of concentrated HCl, 1550 g of $CF_2Cl—CF_2Cl/CF_3—CFCl_2$ (mixing ratio 82/18), 2 g of $Pb(OCOCH_3)_2.2H_2O$ and 2 g of $[CH_3(C_8H_{15})_3N]\ominus Cl\oplus$. Temperature: 0°-5° C., current density: 200 mA/cm², voltage: 11-9 volts, flow rate: 400 litres/hour.

The product left the catholyte in gaseous form. Entrained starting material and by-product formed were condensed in two cold traps connected in series at −78° C. The product could be collected in a cold trap at −196° C.

After a charge of 262 ampere-hours had been consumed and 40.3 litres of hydrogen evolved, the electrolysis was discontinued and the catholyte was worked up by distillation. The contents of the cold traps were subjected to refrigerated distillation. Altogether, the following were obtained: 192.7 g of $CF_2=CF_2$(yield: 80.2%, relative to $CF_2Cl—CF_2Cl$ converted), 956 g of starting material and 100 g of $CF_3—CHClF$.

7) Electrolysis cell 1:

Starting catholyte: 500 g of $$CF_3—CF_2—CF_2—O—\overset{\overset{\displaystyle CF_3}{|}}{CF}—CF_2—O—\overset{\overset{\displaystyle CF_3}{|}}{CF}—COOH,$$

1000 g of water, 600 g of $CF_2ClCFCl_2$, 2 g of $Pb(OCOCH_3)_2.2H_2O$, 5 g of $[(C_4H_9)_4P]\ominus Cl\oplus$ 1 g of $[CH_3(C_8H_{15})_3N]\ominus Cl\oplus$.

Temperature: 25°-45° C., current density: 200 mA/cm², voltage: 14-12 volts, flow rate: 400 litres/-hour, pH: 1.4-0.6.

The $CF_2=CFCl$ formed left the cathode compartment in gaseous form and was condensed in cold traps at −78° C.

After a charge of 102 ampere-hours had been consumed and 82.1 litres of hydrogen evolved, the electrolysis was discontinued and 420 g of unreacted starting material were recovered from the catholyte by distillation.

The amount of condensed gas was 97 g (yield 87.8%). The current efficiency was 43.2%.

18) Electrolysis cell 1

Starting catholyte: 350 g of methanesulfonic acid (70% strength in water), 300 g of 20% strength KOH solution, 1000 ml of water, 300 g of $CF_2ClCFCl_2$, 2 g of $Pb(OCOCH_3)_2.H_2O$ and 1 g of $[(C_4H_9)_4P]\ominus Cl\oplus$. Temperature: 30°-45° C., voltage: 12-9 volts, current density: 150 mA/cm², flow rate: 400 litres/hour, pH: 0.8-0.2.

The $CF_2=CFCl$ formed left the cathode compartment in gaseous form and was condensed in cold traps at −78° C. 110 g/hour, i.e. altogether 600 g, of $CF_2Cl—CFCl_2$were subsequently metered into the catholyte in the course of the electrolysis. After a charge of 162 ampere-hours had been consumed and 5.1 litres of hydrogen evolved, the electrolysis was discontinued and 674 g of unreacted starting material were recovered from the catholyte by distillation.

The condensed gas was subjected to refrigerated distillation. Yield 285 g of $CF_2=CFCl$ (81.8%). The current efficiency was 76.14%.

9) Electrolysis cell 1:

Starting catholyte: 1000 g of chloroacetic acid, 500 g of sodium chloroacetate, 2000 ml of water, 200 g of $CF_2ClCFCl_2$, 2 g of $Pb(OCOCH_3)_2.2H_2O$ and 5 g of $(C_4H_9)_4N]\ominus Cl\oplus$. Temperature; 25°-45° C., voltage: 8-6.3 volts, current density: 200 mA/cm², flow rate: 3100 litres/hour, pH: 4.45-0.5.

The $CF_2=CFCl$ formed left the cathode compartment in gaseous form and was condensed in cold traps at −78° C.

During the electrolysis 200 g/hour, i.e. altogether 2000 g, of $CF_2Cl—CFCl_2$ were added to the catholyte. After a charge of 402 ampere-hours had been consumed and 19.3 litres of hydrogen evolved, the electrolysis was discontinued and 903 g of unreacted starting material were recovered from the catholyte by distillation.

The condensed gas was subjected to refrigerated distillation. Yield 668 g of $CF_2=CFCl$ (81.7%). The current efficiency was 72.7%.

Comparison 1) A starting catholyte composed of 2.5 kg of water, 100 g of concentrated hydrochloric acid, 808 g of $CF_2Cl—CFCl_2$ and 1 g of the cationic emulsifier ®Dodigen 1490 (Hoechst AG, Frankfurt-am-Main, West Germany) was electrolyzed in electrolysis cell 1.

Temperature: 30° to 34° C., voltage: 5.5 to 8 volts, current density: 150 mA/cm², flow rate: 750 to 1300 litres/hour.

Concentrated hydrochloric acid in water was oxidized to chlorine at an anode composed of electrode graphite. The anode and cathode compartments were separated by a cation exchanger membrane of the type Nafion 324.

At the start of the electrolysis the voltage was 5.5 volts. After a charge of 45 ampere-hours had been consumed the voltage had risen to 7.5 volts and it increased further by approx. 0.1 volt per minute. 74% of the charge was consumed for the evolution of hydrogen from protons.

After the electrolysis had been discontinued it was found that the cation exchanger membrane was very severely damaged.

Comparison 2) Electrolysis cell 1

Starting catholyte: 2000 ml of methanol, 100 ml of concentrated hydrochloric acid and 500 g of $CF_2Cl—CFCl_2$.

Temperature: 31° to 34° C., current density: 200 mA/cm², voltage: 8 to 7.5 volts, flow rate: 500 litres/-hour.

The proportion of the charge consumed for the evolution of hydrogen rose from 28% to 65% in the course of one hour. After 1 g of $Pb(OCOCH_3)_2.2H_2O$ had been added to the catholyte, the evolution of hydrogen was reduced to a proportion of 37%, which increased to 47% in the course of 15 minutes. After 2 g of $[(C_4H_9)_4N]^{\ominus}Br^{\oplus}$ had been added only 14% of the charge was consumed for the evolution of hydrogen.

After a charge of 216 ampere-hours had been consumed 238 g of $CF_2{=}CFCl$ (92%) were obtained.

It can be seen from Comparison 2 that only the use of carbon cathodes and the use of a combination of metal salts and compounds of the formulae (III) to (VI) make it possible to carry out the electrolysis efficiently.

I claim:

1. A process for the preparation of a compound of the formula

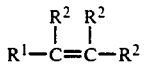

(I)

which comprises electrolyzing A) a compound of the formula

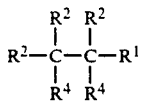

(II)

in which the $R^1$s independently of one another are hydrogen, chlorine or fluorine, the $R^2$s are $R^1$ or $—C(R^1)_2—R^3$, or the grouping $[C(R^1)_2]_m—C(R^1)_2$ represents two of the radicals $R^2$, $R^3$ is $—(CH_2)_n—CH_2—R^5$, $—(CF_2)_n—CH_2—R^5$, $—(CF_2)_n—CF_2—R^5$ or $C_1$-$C_{12}$-alkyl which is partly or completely fluorinated, the $R^4$s independently of one another are chlorine, bromine or iodine, $R^5$ is $R^1$, bromine, iodine, $—CO—R^6$ or $—SO_2—R^6$, $R^6$ is —OH, —O—alkyl having 1 to 6 carbon atoms in the alkyl radical, fluorine or chlorine.

m and n independently denote zero or an integer from 1 to 12, and at least one $R^1$ is fluorine, in a divided or undivided electrolysis cell in the presence of B) at least one onium compound containing at least one nitrogen or phosphorus atom, and C) at least one soluble metal salt having a hydrogen overvoltage greater than 0.25 volts, relative to a current density of 100 mA/cm², in D) an electrolyte and E) optionally in the absence or presence of 5 to 60% by weight, relative to the total amount of the electrolyte, of at least one inorganic or organic acid or mixtures of said acids or salts thereof, under atmospheric pressure or under an elevated pressure of up to 10 bar at a current density of 1 to 600 mA/cm² and at a temperature within the range from −40° C. to the boiling point of the electrolyte, at a carbon electrode.

2. The process as claimed in claim 1, wherein as component C) salts of the metals lead (Pb), chromium (Cr), copper (Cu), silver (Ag), thallium (Tl) and bismuth (Bi) are employed, the anions being $Cl^-$, $SO_4^{2-}$, $NO_3^-$, $CH_3COO^{31}$ and $PO_4^{3-}$.

3. The process as claimed in claim 1, wherein the electrolysis temperature is −30 to 90° C., the current density is 10 to 500 mA/cm², and the pressure is up to 7 bar.

4. The process as claimed in claim 1, wherein the dichlorides, dibromides or bromochloride addition products of appropriate olefins are employed as the compounds of the formula (II).

5. The process as claimed in claim 4, wherein the dichlorides, dibromides or bromochloride addition products of 1,1,2,2-tetrafluoroethylene, 1,1,2-trifluoro-2-chloroethylene, 1,1,2-trifluoroethylene, the various dichlorodifluoroethylenes, difluoroethylenes or difluorochloroethylenes, 1,1,2-trichloro2-fluoroethylene, fluoroethylene, the various dichlorofluoroethylenes and chlorofluoroethylenes and hexafluoropropene are employed.

6. The process as claimed in claim 1, wherein the onium compounds B) employed are compounds of the formulae

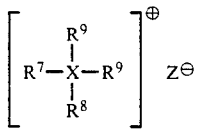

(III)

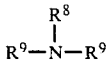

(IV)

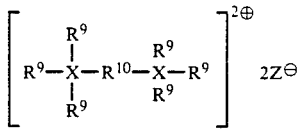

(V)

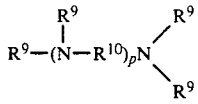

(VI)

in which

X denotes phosphorus or nitrogen, $R^7$ denotes hydrogen, alkyl, cycloalkyl, aralkyl having 1 to 18 carbon atoms in the alkyl radical and aryl having 6 to 12 carbon atoms, $R^8$ is the same as $R^7$ or denotes $—(R^7—O)_pR^7$, $R^9$ is the same as $R^7$ or $R^8$ or denotes $—CH_2(Y)_qCH_2—$, $R^{10}$ is $—(CH_2)_p—$, $—CH_2—[O—(CH_2)_p]_q—O—(CH_2)_2—$, p is an integer from 1 to 12, q is zero or an integer from 1 to 6, Y denotes nitrogen, oxygen, sulfur or $—CH_2—$and Z denotes —OH or an anion of an inorganic or organic acid.

7. The process as claimed in claim 1, wherein electrode graphite, impregnated graphite, porous graphite, carbon felts, vitreous carbon or carbon-plastic composite materials are employed as the carbon electrode.

8. The process as claimed in claim 1, wherein the electrolysis is carried out continuously or discontinuously.

9. The process as claimed in claim 1, wherein the electrolysis is carried out in divided electrolysis cells in which a catholyte $D_1$) and an anolyte $D_2$) are present.

10. The process as claimed in claim 1, wherein water and as component E) 10 to 50% by weight of at least one organic acid and/or salts thereof are employed.

11. The process as claimed in claim 10, wherein the organic acid employed is formic acid, acetic acid, chloroacetic acid, methanesulfonic acid, methanephosphonic acid or the fluorinated ether-carboxylic acids $$CF_3-CF_2-CF_2-O-(\overset{CF_3}{\overset{|}{C}}F-CF_2O)_r-\overset{CF_3}{\overset{|}{C}}F-COOH$$

in which r = 0 and 1.

12. The process as claimed in claim 10, wherein the ammonium, sodium, potassium or tetralkylammonium salts, having 1 to 4 carbon atoms in the alkyl radical, of the acids E) are employed.

13. The process as claimed in claim 1, wherein at least one organic solvent, water or a mixture of both is employed as the electrolyte D) or as the catholyte $D_1$).

14. The process as claimed in claim 13, wherein the organic solvent is methanol, ethanol, the various propanols, ethylene glycol, dioxane, N,N-dimethylformamide and N-methyl-2-pyrrolidone.

15. The process as claimed in claim 1, wherein the compounds of the formula (II) are employed in amounts of 1% to 60%, relative to the total amount of the electrolyte D) or the catholyte $D_1$).

16. The process as claimed in claim 1, wherein the salts C) are employed in amounts from $10^{-5}$ to 5% by weight, in each case relative to the total amount of the electrolyte or catholyte.

17. The process as claimed in claim 1, wherein the compounds B) are added in amounts from $10^{-5}$ to 10% by weight, relative to the total amount of D) or $D_1$).

* * * * *

UNITED STATES PATENT AND TRADEMARK OFFICE

CERTIFICATE OF CORRECTION

PATENT NO. : 5,026,460

DATED : June 25, 1991

INVENTOR(S) : Steffen Dapperheld

It is certified that error appears in the above-identified patent and that said Letters Patent is hereby corrected as shown below:

Column 14, line 9, "$CH_3COO^{31}$" should read --$CH_3COO$--.

Signed and Sealed this

Sixteenth Day of February, 1993

*Attest:*

STEPHEN G. KUNIN

*Attesting Officer*

*Acting Commissioner of Patents and Trademarks*